US012507810B2

(12) United States Patent
Wang et al.

(10) Patent No.: US 12,507,810 B2
(45) Date of Patent: Dec. 30, 2025

(54) SOFA WITH ADJUSTABLE COUPLED HEADREST AND BACKREST

(71) Applicant: JASON FURNITURE (HANGZHOU) CO., LTD., Zhejiang (CN)

(72) Inventors: Ping Wang, Zhejiang (CN); Sheng Wang, Zhejiang (CN); Luping Shi, Zhejiang (CN); Linlin Wu, Zhejiang (CN); Jingbo Ning, Zhejiang (CN)

(73) Assignee: JASON FURNITURE (HANGZHOU) CO., LTD., Zhejiang (CN)

( * ) Notice: Subject to any disclaimer, the term of this patent is extended or adjusted under 35 U.S.C. 154(b) by 22 days.

(21) Appl. No.: 18/657,925

(22) Filed: May 8, 2024

(65) Prior Publication Data

US 2025/0024955 A1 Jan. 23, 2025

Related U.S. Application Data

(63) Continuation of application No. PCT/CN2024/073751, filed on Jan. 24, 2024.

(30) Foreign Application Priority Data

Jul. 21, 2023 (CN) ..... 202321943264.1

(51) Int. Cl.
*A47C 17/175* (2006.01)
*A47C 17/16* (2006.01)
*A47C 17/17* (2006.01)

(52) U.S. Cl.
CPC ..... *A47C 17/1756* (2013.01); *A47C 17/175* (2013.01); *A47C 17/16* (2013.01); *A47C 17/17* (2013.01)

(58) Field of Classification Search
CPC ... A47C 17/1756; A47C 17/175; A47C 17/17; A47C 17/16
(Continued)

(56) References Cited

U.S. PATENT DOCUMENTS

2025/0024955 A1* 1/2025 Wang ..... A47C 17/1756

FOREIGN PATENT DOCUMENTS

AT 1764 U1 * 11/1997 ..... A47C 17/1756
AT 2046 U1 * 4/1998 ..... A47C 17/1756
(Continued)

OTHER PUBLICATIONS

International Search Report for corresponding patent application No. PCT/CN2024/073751, mailed Apr. 15, 2024, 3 pages.

*Primary Examiner* — Robert G Santos
(74) *Attorney, Agent, or Firm* — Cooper Legal Group, LLC

(57) ABSTRACT

A sofa with an adjustably coupled headrest and backrest includes a base movably connected with a side panel and a coupling sheet for backrest hinged at the side panel, and a backrest assembly including a connection element of backrest with a front end hinged at a rear end of the side panel at an upper position and a connection rod of backrest with an upper end hinged at a rear end of the connection element of backrest, and with a lower end hinged at the coupling sheet for backrest, the base is provided with a drive member to switch a backrest frame to a lying position, and a coupling assembly for headrest configured to force the connection element for headrest to flip relative to a backrest skeleton is provided between the connection rod of backrest and the connection element for headrest.

7 Claims, 5 Drawing Sheets

(58) Field of Classification Search
USPC ..... 5/12.1, 37.1
See application file for complete search history.

(56) References Cited

FOREIGN PATENT DOCUMENTS

| | | | | | |
|---|---|---|---|---|---|
| CN | 201775313 | U | | 3/2011 | |
| CN | 206576626 | U | | 10/2017 | |
| CN | 108402767 | A | | 8/2018 | |
| CN | 217658890 | U | | 10/2022 | |
| JP | 2010099105 | A | | 5/2010 | |
| KR | 20200006724 | A | | 1/2020 | |
| WO | WO-9824344 | A1 | * | 6/1998 | ..... A47C 17/1756 |
| WO | WO-9848672 | A1 | * | 11/1998 | ..... A47C 17/1756 |
| WO | WO-2025020484 | A1 | * | 1/2025 | ..... A47C 17/86 |

* cited by examiner

SOFA WITH ADJUSTABLE COUPLED HEADREST AND BACKREST

CROSS-REFERENCE TO RELATED APPLICATIONS

This application is a continuation of PCT application serial no. PCT/CN2024/073751, filed on Jan. 24, 2024, which claims the priority and benefit of Chinese patent application serial no. 202321943264.1, filed on Jul. 21, 2023. The entireties of PCT application serial no. PCT/CN2024/073751 and Chinese patent application serial no. 202321943264.1 are hereby incorporated by reference herein and made a part of this specification.

Technical Field

The present application relates to the technical field of functional furniture, and in particular, to a sofa with adjustable coupled headrest and backrest.

State of the Art

The existing functional sofas usually have a function of switching among the sitting position, the TV pose and the lying position, so as to meet most of user needs for daily use of the seating furniture.

For example, a granted Chinese patent CN217658890U discloses an extension device for functional sofa including a base, a coupling assembly, a leg assembly and a backrest assembly, the coupling assembly includes a first support rod with a lower end rotatably connected to the base, a second support rod with a lower end rotatably connected to the base, a first linkage with an end rotatably connected to the upper end of the first support rod, and a first coupling sheet rotatably connected between the upper end of the second support rod and the other end of the first linkage. The coupling assembly further includes a side panel, in particular, the leg assembly and the backrest assembly are respectively mounted at two ends of the side panel, and a drive rod passes through the side panel and is connected to the leg assembly. A limiter is rotatably connected between the first linkage and an end of the side panel close to the leg assembly, and a coupling point is provided at a position of the side panel close to the backrest assembly, the first coupling sheet is rotatably connected to the coupling point. When the extension device is in the sitting position or the TV pose, a rotation point of the first linkage and the first coupling sheet is located in height between the coupling point and the upper end of the second support rod. A functional part is rotatably connected to the side panel, the upper and lower ends of the functional part are respectively rotatably connected with a first functional rod and a second functional rod, one end of the first functional rod is rotatably connected to the first support rod, and one end of the second functional rod is rotatably connected to the leg assembly. The coupling assembly further includes a traction element, one end of the traction element is connected to the first linkage or the first coupling sheet, the other end of the traction element is connected to the first support rod or the base, and the traction element applies a traction force to the first coupling sheet, so that the first coupling sheet rotates around the coupling point toward the leg assembly. A sofa backrest is mounted on a connection element for backrest of the backrest assembly.

In order to improve the use comfort of the functional sofas, the sofa backrest is usually further provided with a headrest for the head of the users to lean against. The angle adjustment of the headrests is controlled and adjusted individually through a motor, which increases the production cost of the functional sofa. Further improvements are therefore needed.

SUMMARY

In order to reduce the production cost of functional sofas, the present application provides a sofa with adjustable coupled headrest and backrest.

The sofa with adjustable coupled headrest and backrest provided by the application adopts the following technical scheme.

A sofa with adjustable coupled headrest and backrest includes a base and a backrest assembly, the base is movably connected with a side panel and a coupling sheet for backrest configured to be hinged at the side panel, the backrest assembly includes a connection element of backrest and a connection rod of backrest, in particular, a front end of the connection element of backrest is hinged at a rear end of the side panel at an upper position, an upper end of the connection rod of backrest is hinged at a rear end of the connection element of backrest, a lower end of the connection rod of backrest is hinged at the coupling sheet for backrest, in which the connection element of backrest, the connection rod of backrest, the coupling sheet for backrest and the side panel form a four-bar linkage structure, the base is provided with a drive member configured for driving the side panel to swing, so that a backrest frame is switched to be in a lying position, particularly, the connection element of backrest is detachably connected with the backrest frame, the backrest frame is hinged with a connection element for headrest located above the connection element of backrest, and a coupling assembly for headrest configured to force the connection element for headrest to flip relative to a backrest skeleton is provided between the connection rod of backrest and the connection element for headrest.

In the above-mentioned configuration, when the drive member drives the side panel to swing, so that the backrest frame is switched to be in a lying position, the coupling assembly for headrest between the connection rod of backrest and the connection element for headrest forces the connection element for headrest to flip relative to the backrest skeleton for adjustment, so as to realize the movement transmission without further providing additional drive elements, so that the production cost of the functional sofa is effectively reduced.

Preferably, the connection element for headrest includes a first headrest rod hinged at the backrest frame at a lower part of the first headrest rod and a second headrest rod fixedly connected to a lower end of the first headrest rod, in particular, the coupling assembly for headrest includes a first coupling sheet for headrest, a second coupling sheet for headrest, a first headrest linkage, a reversing link and a second headrest linkage, a lower part of the first coupling sheet for headrest is hinged at the connection rod of backrest, a lower part of the second coupling sheet for headrest is at a front side hinged at the connection element of backrest, the lower part of the second coupling sheet for headrest is at a rear side hinged at an upper part of the first coupling sheet for headrest, a lower part of the first headrest linkage is hinged at an upper part of the second coupling sheet for headrest, a middle part of the reversing link is hinged at the backrest frame, a front side of the reversing link is hinged at an upper part of the first headrest linkage, a rear side of the reversing link is hinged at a lower part of the second headrest linkage and an upper part of the second headrest linkage is hinged at a lower part of the second headrest rod.

In the above-mentioned configuration, when the backrest frame is switched from the TV pose to the lying posture, the front side of the connection element of backrest tilts upward and the rear side of the connection element of backrest flips downward, so that the angle between the connection element of backrest and the connection rod of backrest is increased. In this process, the upper part of the second coupling sheet for headrest swings rearward relative to the connection element of backrest, so that the front side of the reversing link is pulled through the first headrest linkage to swing downward relative to the backrest frame, and the rear side of the reversing link to swing upward relative to the backrest frame, and in turn the lower end of the second headrest rod is pushed through the second headrest linkage to flip upward relative to the backrest frame, so that the upper part of the first headrest rod swings forward relative to the backrest frame, so as to form a protrusion on the support surface of the backrest frame for the head of users to lean against.

Preferably, the backrest frame is detachably connected with a mount sheet, the first headrest rod is hinged at an upper part of the mount sheet, and the reversing link is hinged at a lower part of the mount sheet.

In the above-mentioned configuration, after the coupling assembly for headrest, the connection element for headrest and the mount sheet are assembled, the backrest frame is then mounted on the connection element of backrest and the mount sheet respectively, to achieve the assembly of the backrest frame and the connection element of backrest/connection element for headrest.

Preferably, the backrest frame is locked and fixed on the connection element of backrest by bolts, and the second coupling sheet for headrest is hinged at the first headrest linkage by a matching of bolt and nut.

In the above-mentioned configuration, the first headrest linkage, the reversing link, the second headrest linkage and the connection element for headrest are independently mounted on the backrest frame. The second coupling sheet for headrest is hinged with the first headrest linkage by the matching of bolt and nut, so as to realize the detachable connection between the second coupling sheet for headrest and the first headrest linkage. When the sofa is transported, the second coupling sheet for headrest is disconnected from the first headrest linkage, and the backrest frame is disconnected from the connection element of backrest, so that the backrest frame is separately packaged to improve transportation convenience.

Preferably, the second coupling sheet for headrest is configured with an arc-shaped limit slot, an axis of the limit slot coincides with a hinge axis of the second coupling sheet for headrest and the first coupling sheet for headrest, and the first coupling sheet for headrest is provided with a limit rod configured to be slidable in the limit slot and protrude from the first coupling sheet for headrest.

In the above-mentioned configuration, a limit rod is provided. When the limit rod abuts against the inner walls at two ends of the limit slot, the backrest frame cannot continue to flip forward or backward, so as to limit the flipping angle of the backrest frame and improve the structural stability of the backrest frame.

Preferably, a wear-resistant sleeve is fixedly sleeved on the limit rod.

In the above-mentioned configuration, a wear-resistant sleeve is further provided, so that the possibility of rigid contact between the limit rod and the second coupling sheet for headrest is reduced, which extends the service life of the limit rod and the second coupling sheet for headrest, and effectively reduces the possibility of noise generation when the limit rod collides with the inner wall of the limit slot.

Preferably, the limit rod is a limit bolt configured to pass through the wear-resistant sleeve, the limit bolt is in a threaded connection with the first coupling sheet for headrest, and a nut of the limit bolt abuts against an end surface of the wear-resistant sleeve.

In the above-mentioned configuration, the limit rod is a limit bolt, which facilitates the replacement of the damaged wear-resistant sleeve.

Preferably, the backrest frame is a wooden frame.

In the above-mentioned configuration, the backrest frame is a wooden frame, which effectively reduces the entire manufacturing cost of the sofa compared to an iron keel.

To sum up, the application includes the following beneficial technical effects:

1. When the drive member drives the side panel to swing, so that the backrest frame is switched to be in a lying position, the coupling assembly for headrest between the connection rod of backrest and the connection element for headrest forces the connection element for headrest to flip relative to the backrest skeleton for adjustment, so as to realize a movement transmission without further providing additional drive elements, so that the production cost of the functional sofa is effectively reduced.
2. The first headrest linkage, the reversing link, the second headrest linkage and the connection element for headrest are independently mounted on the backrest frame. The second coupling sheet for headrest is hinged with the first headrest linkage by the matching of bolt and nut, so as to realize the detachable connection between the second coupling sheet for headrest and the first headrest linkage. When the sofa is transported, the second coupling sheet for headrest is disconnected from the first headrest linkage, and the backrest frame is disconnected from the connection element of backrest, so that the backrest frame is separately packaged, to improve transportation convenience.

DETAILED EMBODIMENTS

The disclosure will be further described in detail below in combination with FIGS. 1-5.

Figure 1:
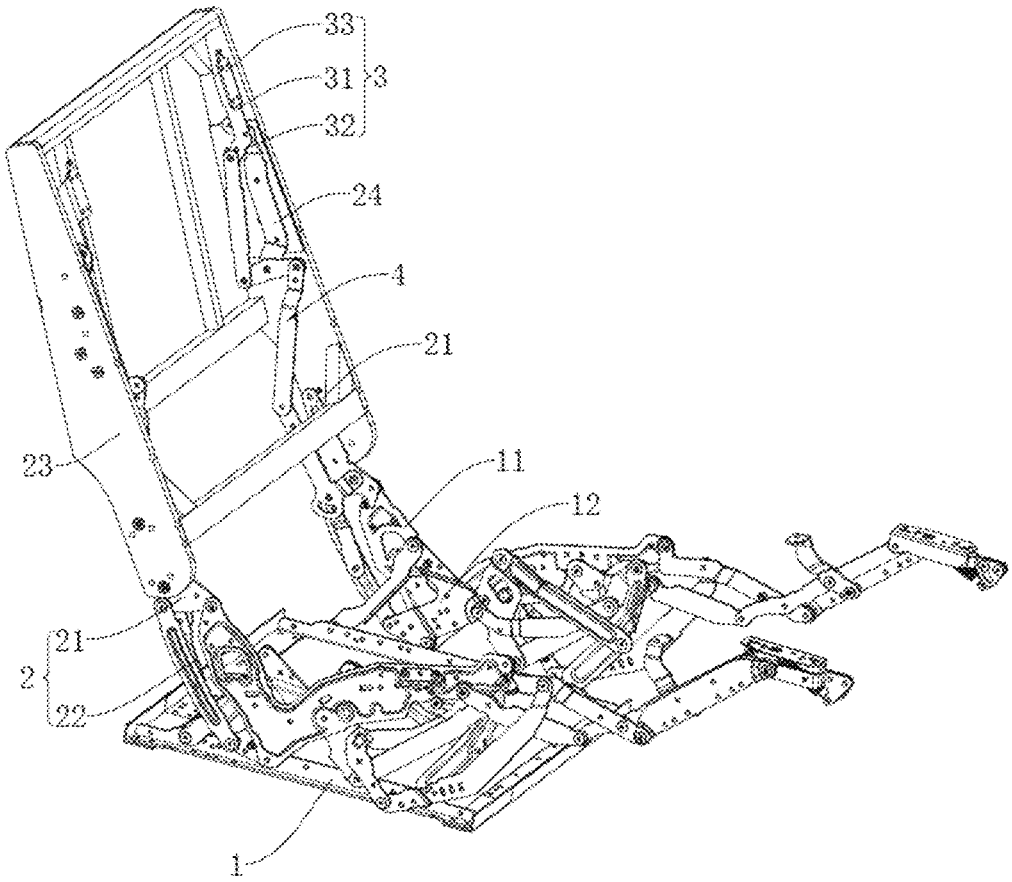
FIG. 1 is a schematic view showing the overall structure of a sofa with adjustable coupled headrest and backrest.
Figure 2:
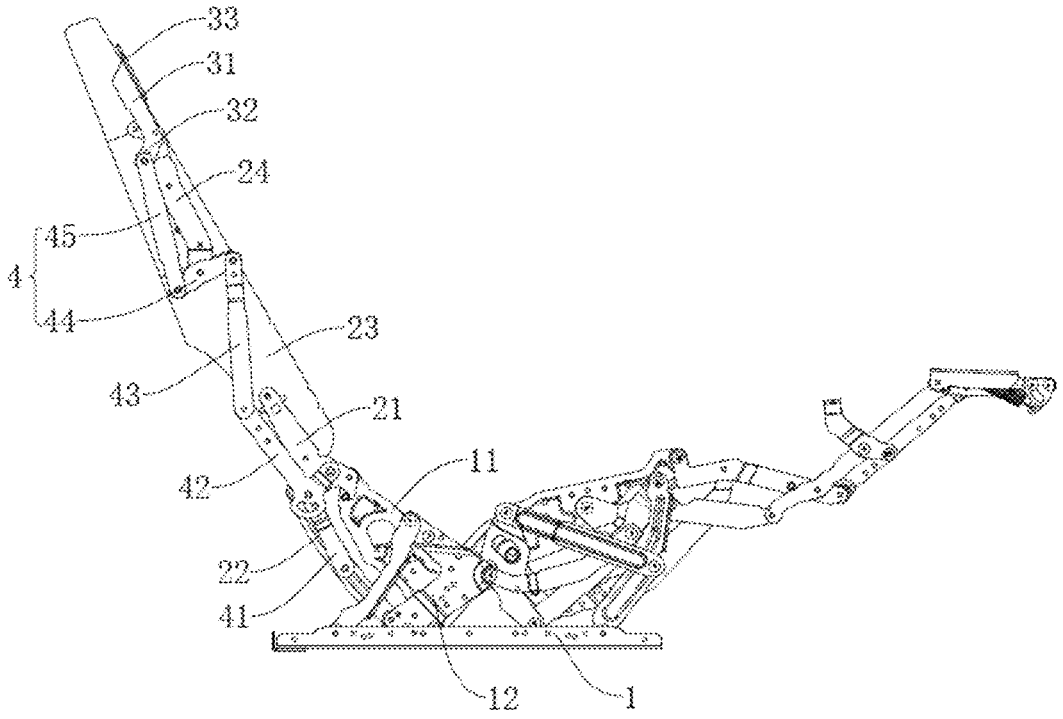
FIG. 2 is a structural schematic diagram of the sofa in a TV pose.

Referring to FIG. 1 and FIG. 2, an embodiment of the application discloses a sofa with an adjustably coupled headrest and backrest including a base 1 and a backrest assembly 2, the base 1 is movably connected with a side panel 11 and a coupling sheet for backrest 12 hinged at the side panel 11. The backrest assembly 2 includes a connection element of backrest 21 and a connection rod of backrest 22, the front end of the connection element of backrest 21 is hinged at the rear end of the side panel 11 at an upper position, the upper end of the connection rod of backrest 22 is hinged at the rear end of the connection element of backrest 21, the lower end of the connection rod of backrest 22 is hinged at the coupling sheet for backrest 12. The connection element of backrest 21, the connection rod of backrest 22, the coupling sheet for backrest 12 and the side panel 11 form a four-bar linkage structure. The base 1 is provided with a drive member for driving the side panel 11 to swing, so that the backrest frame 23 is switched from a TV pose to a lying position. In this embodiment, the base 1 adopts the overall structure of an extension device for a functional sofa disclosed in the granted Chinese patent CN217658890U. The base 1, the side panel 11, the coupling sheet for backrest 12, the backrest assembly 2 and the drive member are all existing technologies and are not described in detail here.

The upper part of the connection element of backrest 21 is detachably connected with a backrest frame 23 by means of bolts. In the present embodiment, the backrest frame 23 is a wooden frame, and the upper part of the connection element of backrest 21 extends to the inner cavity of the backrest frame 23. The inner wall of the backrest frame 23 is detachably connected with a mount sheet 24 by means of bolts. The upper part of the mount sheet 24 is provided with a connection element for headrest 3 located above the connection element of backrest 21. The connection element for headrest 3 includes a first headrest rod 31 articulated at the lower part to the mount sheet 24, a second headrest rod 32 fixedly connected to the lower end of the first headrest rod 31, and a mount plate for headrest 33 fixedly connected to the front side of the free end of the first headrest rod 31. The plate surface of the mount plate for headrest 33 is parallel to the front surface of the backrest frame 23. The mount plate for headrest 33 is configured for mounting a support plate for headrest (not shown in the figure).

Figure 3:
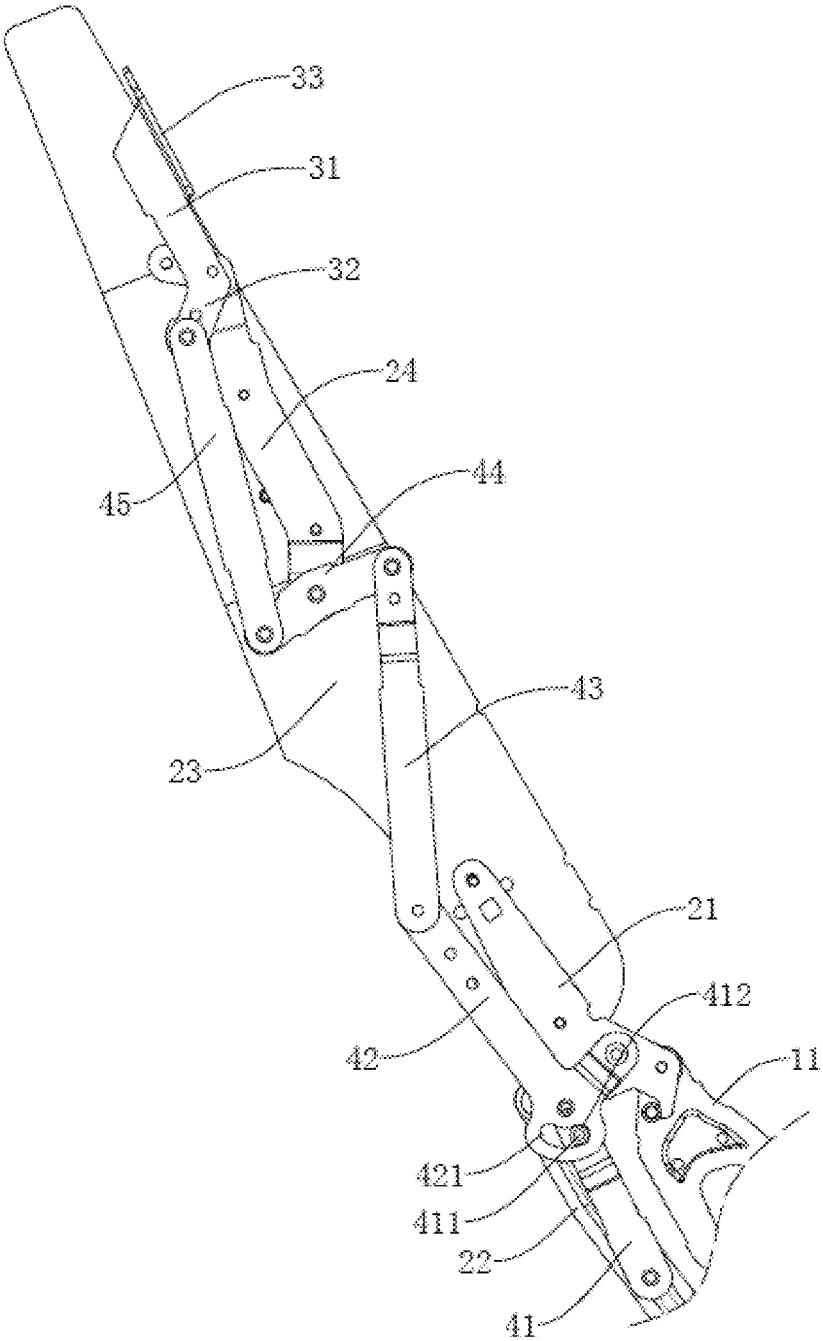
FIG. 3 is a schematic structural diagram of the coupling assembly for headrest.

Referring to FIG. 2 and FIG. 3, a coupling assembly for headrest 4 configured for driving the connection element for headrest 3 to flip relative to the backrest skeleton is provided between the connection rod of backrest 22 and the second headrest rod 32. The coupling assembly for headrest 4 includes a first coupling sheet for headrest 41, a second coupling sheet for headrest 42, a first headrest linkage 43, a reversing link 44 and a second headrest linkage 45. The lower part of the first coupling sheet for headrest 41 is hinged at the middle part of the connection rod of backrest 22, the lower part of the second coupling sheet for headrest 42 at the front side is hinged at the connection element of backrest 21, and the lower part of the second coupling sheet for headrest 42 at the rear side is hinged at the upper part of the first coupling sheet for headrest 41. The lower part of the first headrest linkage 43 is hinged at the upper part of the second coupling sheet for headrest 42, the reversing link 44 is located between the second coupling sheet for headrest 42 and the second headrest rod 32, the middle part of the reversing link 44 is hinged at the lower part of the mount sheet 24, the front side of the reversing link 44 is hinged at the upper part of the first headrest linkage 43, the rear side of the reversing link 44 is hinged on the lower part of the second headrest linkage 45, and the upper part of the second headrest linkage 45 is hinged at the lower part of the second headrest rod 32. In particular, the second coupling sheet for headrest 42 is hinged with the first headrest linkage 43 by the fit of bolt and nut, which facilitates the disassembly of the second coupling sheet for headrest 42 and the first headrest linkage 43.

Figure 4:
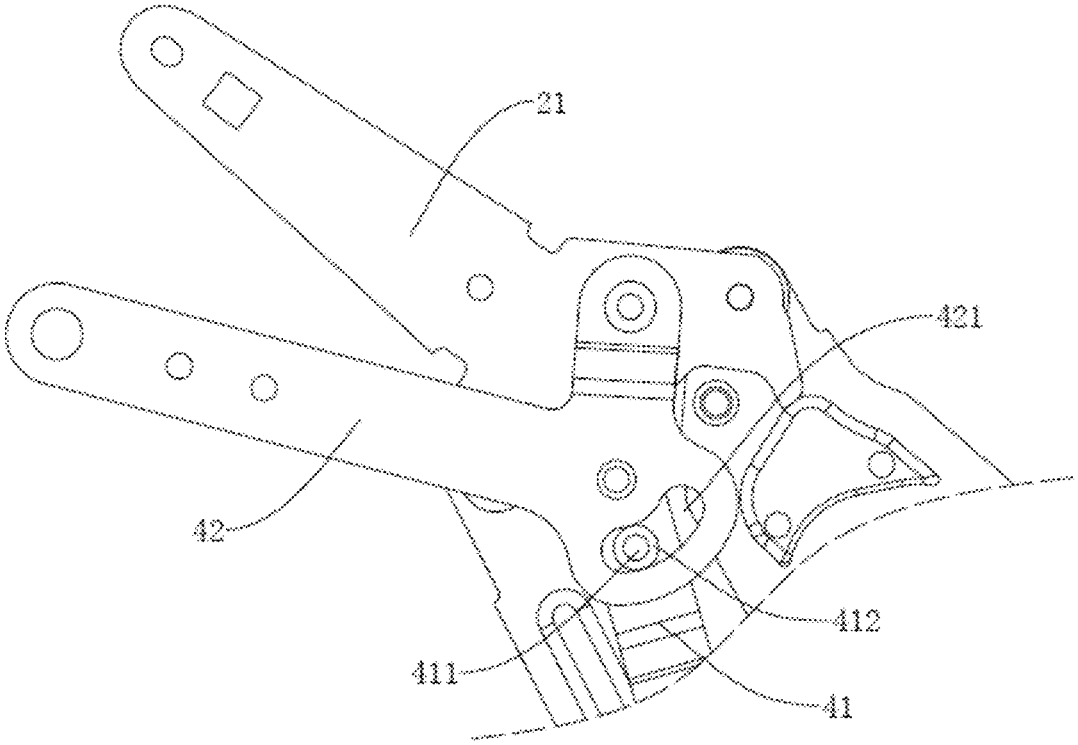
FIG. 4 is a schematic diagram of the connection structure of the first coupling sheet for headrest and the second coupling sheet for headrest.
Figure 5:
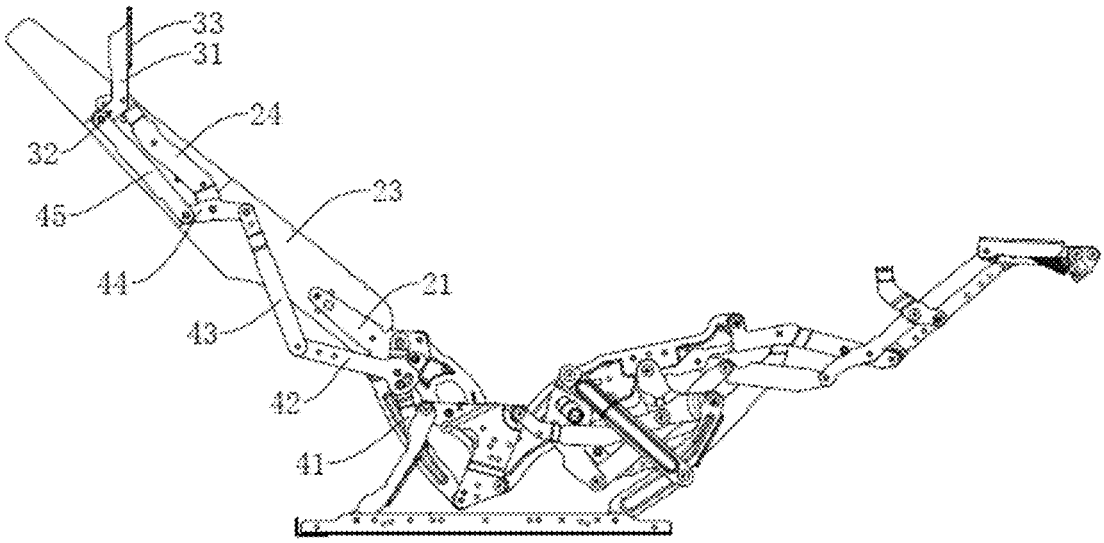
FIG. 5 is a structural schematic diagram of the sofa in a lying position.

Referring to FIG. 3 and FIG. 4, the side wall of the second coupling sheet for headrest 42 is configured with an arc-shaped limit slot 421 which passes through the side wall, the axis of the limit slot 421 coincides with the hinge axis of the second coupling sheet for headrest 42 and the first coupling sheet for headrest 41. The first coupling sheet for headrest 41 is provided with a limit rod 411 which protrudes out of the outer wall thereof and is slidable in the limit slot 421. The projection of the axis of the limit rod 411, of the hinge axis between the first coupling sheet for headrest 41 and the connection rod of backrest 22, and of the hinge axis between the first coupling sheet for headrest 41 and the second coupling sheet for headrest 42 on the plane where the first coupling sheet for headrest is located are in a straight line. The limit rod 411 is sleeved by a wear-resistant sleeve 412. The wear-resistant sleeve 412 is a plastic sleeve. The limit rod 411 is a limit bolt configured to pass through the wear-resistant sleeve 412, the limit bolt is in a threaded connection with the first coupling sheet for headrest 41, and the nut of the limit bolt abuts against the end surface of the wear-resistant sleeve 412.

The implementation principle of the sofa with adjustable coupled headrest and backrest in the embodiment of the present application is as follows: during the switching of the sofa from a sitting position to a TV pose, the angle between the connection rod of backrest 22 and the connection element of backrest 21 is slightly changed, which may be ignored, so that it can be regarded that the first coupling sheet for headrest 41 doesn't move relative to the connection element of backrest 21, and the limit rod 411 is located at the front end of the limit slot 421; during the switching of the sofa from a TV pose to a lying position, the front side of the connection element of backrest 21 tilts upward and the rear side of the connection element of backrest 21 flips downward, so that the angle between the connection element of backrest 21 and the connection rod of backrest 22 is increased. In this process, the upper part of the second coupling sheet for headrest 42 swings rearward relative to the connection element of backrest 21, so that the front side of the reversing link 44 is pulled by the first headrest linkage 43 to swing downward relative to the backrest frame 23, and the rear side of the reversing link 44 to swing upward relative to the backrest frame 23, and in turn the lower end of the second headrest rod 32 is pushed by the second headrest linkage 45 to flip upward relative to the backrest frame 23, so that the upper part of the first headrest rod 31 swings forward relative to the backrest frame 23, so as to form a protrusion on the support surface of the backrest frame 23 for the head of users to lean against. When the limit rod 411 is located at the rear end of the limit slot 421, the backrest frame 23 stops swinging (referring to FIG. 5).

The above are all preferred embodiments of the application, and do not limit the scope of protection of the application. Therefore, any equivalent changes made based on the structure, shape, and principle of the application shall be covered by the protection scope of the application.

Reference Signs List

1 base
11 side panel
12 coupling sheet for backrest
2 backrest assembly
21 connection element of backrest
22 connection rod of backrest
23 backrest frame
24 mount sheet

3 connection element for headrest
31 first headrest rod
32 second headrest rod
33 mount plate for headrest
4 coupling assembly for headrest
41 first coupling sheet for headrest
411 limit rod
412 wear-resistant sleeve
42 second coupling sheet for headrest
421 limit slot
43 first headrest linkage
44 reversing link
45 second headrest linkage

What is claimed is:

1. A sofa with an adjustably coupled headrest and backrest, comprising a base and a backrest assembly, wherein the base is movably connected with a side panel and a coupling sheet for backrest configured to be hinged at the side panel, the backrest assembly comprises a connection element of backrest and a connection rod of backrest, wherein a front end of the connection element of backrest is hinged on a rear end of the side panel at an upper position, an upper end of the connection rod of backrest is hinged at a rear end of the connection element of backrest, a lower end of the connection rod of backrest is hinged at the coupling sheet for backrest, wherein the connection element of backrest, the connection rod of backrest, the coupling sheet for backrest and the side panel form a four-bar linkage structure, the base is provided with a drive member configured for driving the side panel to swing, so that a backrest frame is switched to be in a lying position, wherein the connection element of backrest is detachably connected with the backrest frame, the backrest frame is hinged with a connection element for headrest located above the connection element of backrest, and a coupling assembly for headrest configured to force the connection element for headrest to flip relative to a backrest skeleton is provided between the connection rod of backrest and the connection element for headrest, wherein the connection element for headrest comprises a first headrest rod hinged at the backrest frame at a lower part of the first headrest rod and a second headrest rod fixedly connected to a lower end of the first headrest rod, wherein the coupling assembly for headrest comprises a first coupling sheet for headrest, a second coupling sheet for headrest, a first headrest linkage, a reversing link and a second headrest linkage, a lower part of the first coupling sheet for headrest is hinged at the connection rod of backrest, a lower part of the second coupling sheet for headrest is at a front side of the second coupling sheet for headrest hinged at the connection element of backrest, the lower part of the second coupling sheet for headrest is at a rear side of the second coupling sheet for headrest hinged at an upper part of the first coupling sheet for headrest, a lower part of the first headrest linkage is hinged at an upper part of the second coupling sheet for headrest, a middle part of the reversing link is hinged at the backrest frame, a front side of the reversing link is hinged at an upper part of the first headrest linkage, a rear side of the reversing link is hinged at a lower part of the second headrest linkage, and an upper part of the second headrest linkage is hinged at a lower part of the second headrest rod.

2. The sofa with an adjustably coupled headrest and backrest according to claim 1, wherein the backrest frame is detachably connected with a mount sheet, the first headrest rod is hinged at an upper part of the mount sheet, and the reversing link is hinged at a lower part of the mount sheet.

3. The sofa with an adjustably coupled headrest and backrest according to claim 1, wherein the backrest frame is locked and fixed on the connection element of backrest by bolts, and the second coupling sheet for headrest is hinged with the first headrest linkage by a matching of bolt and nut.

4. The sofa with an adjustably coupled headrest and backrest according to claim 1, wherein the second coupling sheet for headrest is configured with an arc-shaped limit slot, an axis of the arc-shaped limit slot coincides with a hinge axis of the second coupling sheet for headrest and the first coupling sheet for headrest, and the first coupling sheet for headrest is provided with a limit rod configured to be slidable in the arc-shaped limit slot and protrudes from the first coupling sheet for headrest.

5. The sofa with an adjustably coupled headrest and backrest according to claim 4, wherein a wear-resistant sleeve is fixedly sleeved on the limit rod.

6. The sofa with an adjustably coupled headrest and backrest according to claim 5, wherein the limit rod is a limit bolt configured to pass through the wear-resistant sleeve, wherein the limit bolt is in a threaded connection with the first coupling sheet for headrest, and a nut of the limit bolt abuts against an end surface of the wear-resistant sleeve.

7. The sofa with an adjustably coupled headrest and backrest according to claim 1, wherein the backrest frame is a wooden frame.

* * * * *